US010098480B1

(12) United States Patent
DeLuca

(10) Patent No.: US 10,098,480 B1
(45) Date of Patent: Oct. 16, 2018

(54) TANGLESS JEWLERY HOLDER AND METHODS OF USING SAME

(71) Applicant: Michela N. DeLuca, Potomac, MD (US)

(72) Inventor: Michela N. DeLuca, Potomac, MD (US)

( * ) Notice: Subject to any disclaimer, the term of this patent is extended or adjusted under 35 U.S.C. 154(b) by 0 days.

(21) Appl. No.: 15/705,384

(22) Filed: Sep. 15, 2017

(51) Int. Cl.
*A45C 11/16* (2006.01)
*A47F 7/02* (2006.01)
*A47F 5/00* (2006.01)
*A45C 7/00* (2006.01)

(52) U.S. Cl.
CPC ..... *A47F 7/02* (2013.01); *A47F 5/0006* (2013.01); *A45C 11/16* (2013.01); *A45C 2007/0013* (2013.01)

(58) Field of Classification Search
CPC ..... A47F 7/02; A47F 7/022; A47F 5/0006; A45C 11/16; Y10S 206/806
USPC ..... 206/6.1, 806
See application file for complete search history.

(56) References Cited

U.S. PATENT DOCUMENTS 549,970 A * 11/1895 Lawrence ..... A47F 7/02 206/493
1,485,646 A * 3/1924 Traumuller ..... A47F 7/02 206/493
2,312,009 A * 2/1943 Traumuller ..... A47F 7/02 206/565
5,121,833 A * 6/1992 Lindsay ..... A45C 7/0095 206/18
5,427,230 A 6/1995 Mattox
5,680,928 A 10/1997 Carr
5,727,677 A 3/1998 Peviani
6,012,571 A * 1/2000 LaPierre ..... A45C 11/16 206/348
6,161,686 A * 12/2000 Simon ..... A45C 11/16 206/6.1
9,326,577 B1 * 5/2016 Gaspari ..... A45C 11/26
9,332,868 B2 5/2016 Jensen
9,392,889 B2 7/2016 Trainor-Smith et al.
9,491,995 B1 11/2016 Sichi
9,516,957 B2 12/2016 Riegle

* cited by examiner

*Primary Examiner* — Anthony Stashick
*Assistant Examiner* — Mollie Impink
(74) *Attorney, Agent, or Firm* — James R. McDaniel

(57) ABSTRACT

A non-slip jewelry holder having a first and second layer of a non-slip material located adjacent to each other, wherein the first layer includes a plurality of slits located along the first layer; at least one set of adjustable prongs located between the first and second layers, wherein the set of adjustable prongs includes two prongs located a distance from each other, wherein each of the two prongs include a prong retainer, a prong edge operatively connected to the prong retainer, a prong extension having a first end and a second end such that the first end of the prong extension is operatively connected to the prong edge and a prong slot such that the second end of the prong extension is operatively connected to the prong slot; and a jeweler holder fastener to retain the non-slip jewelry holder in a rolled-up form.

7 Claims, 8 Drawing Sheets

TANGLESS JEWLERY HOLDER AND METHODS OF USING SAME

FIELD OF THE INVENTION

The present invention is generally related to a non-slip jewelry holder. The jewelry holder keeps each piece of jewelry substantially taught to prevent it from tangling with other pieces of jewelry or itself. Secondly, the jewelry holder employs a non-slip fabric to prevent the jewelry from sliding around. Thirdly, the jewelry holder is portable in that the jewelry holder can be easily rolled up into a compact travel case. Finally, the jewelry holder allows the jewelry to be organized and easy to access.

BACKGROUND OF THE INVENTION

Prior to the present invention, as set forth in general terms above and more specifically below, it is known, to employ various types of jewelry holders. See for example, U.S. Pat. No. 5,427,230 by Mattox, U.S. Pat. No. 5,680,928 by Carr, U.S. Pat. No. 5,727,677 by Peviani, U.S. Pat. No. 9,326,577 by Gaspari et al., U.S. Pat. No. 9,332,868 by Jensen, U.S. Pat. No. 9,392,889 by Trainor-Smith et al., U.S. Pat. No. 9,491,995 by Sichi and U.S. Pat. No. 9,516,957 by Riegle. While these various jewelry holders may have been generally satisfactory, there is nevertheless a need for a new and improved non-slip jewelry holder that keeps each piece of jewelry taught to prevent from it from tangling with other pieces of jewelry or itself and employs a non-slip fabric such that the jewelry holder is easily portable and allows the jewelry to be organized and easy to access.

It is a purpose of this invention to fulfill these and other needs in the jewelry holder art in a manner more apparent to the skilled artisan once given the following disclosure.

BRIEF SUMMARY OF THE INVENTION

A first aspect of the present invention is a non-slip jewelry holder, including a first and second layer of a non-slip material located adjacent to each other, wherein the first layer includes a plurality of slits located along the first layer; at least one set of adjacent, adjustable prongs located between the first and second layers, wherein the set of adjacent, adjustable prongs includes two prongs located a distance from each other, wherein each of the two prongs include a prong retainer, a prong edge operatively connected to the prong retainer, a prong extension having a first end and a second end such that the first end of the prong extension is operatively connected to the prong edge and a prong slot such that the second end of the prong extension is operatively connected to the prong slot; and a jewelry holder fastener operatively connected to the first and second layers in order to retain the non-slip jewelry holder in a roiled-up form.

In one embodiment of the first aspect of the present invention, the non-slip material includes a non-slip fabric.

In another embodiment of the first aspect of the present invention, the prong retainer, the prong edge, and the prong extension includes metal or plastic.

In another embodiment of the first aspect of the present invention, the prong retainer, the prong edge, and a portion of the prong extension are located within the slit and extend a predetermined distance away from the first layer.

In another embodiment of the first aspect of the present invention, the prong slot includes a spring having a first end and a second end, and a spring retainer, wherein the second end of the prong extension is operatively connected to the first end of the spring and the second end of the spring is operatively connected to the spring retainer.

In still another embodiment of the first aspect of the present invention, the prong extension includes a prong latch having a first end and a second end such that the first end of the prong latch is attached to the second end of the prong extension, and a prong spring operatively connected to the prong latch.

In an even further embodiment of the first aspect of the present invention, the prong slot includes a plurality of holes located along a length of the prong slot, wherein the second end of the prong latch interacts with at least one of the plurality of holes in order to retain each of the two prongs in place.

In still another embodiment of the first aspect of the present invention, the non-slip jewelry holder includes at least one handle operatively attached to the first and second layers for carrying, displaying or holding up the non-slip jewelry holder.

A second aspect of the present invention is a non-slip container for storage, organizing, transporting, and displaying jewelry, including a first and second layer of a non-slip material located adjacent to each other, wherein the first layer includes a plurality of slits located along the first layer; at least one set of adjacent, adjustable prongs located between the first and second layers, wherein the set of adjacent, adjustable prongs includes two prongs located a distance from each other, wherein each of the two prongs include a prong retainer, a prong edge operatively connected to the prong retainer, a prong extension having a first end and a second end such that the first end of the prong extension is operatively connected to the prong edge and a prong slot such that the second end of the prong extension is operatively connected to the prong slot; and a jewelry holder fastener operatively connected to the first and second layers in order to retain the non-slip jewelry holder in a rolled-up form.

In one embodiment of the second aspect of the present invention, the non-slip material includes a non-slip fabric.

In another embodiment of the second aspect of the present invention, the prong retainer, the prong edge, and the prong extension includes metal or plastic.

In another embodiment of the second, aspect of the present invention, the prong retainer, the prong edge, and a portion of the prong extension are located within the slit and extend a predetermined distance away from the first layer.

In another embodiment of the second aspect of the present invention, the prong slot includes a spring having a first end and a second end, and a spring retainer, wherein the second end of the prong extension is operatively connected to the first end of the spring and the second end of the spring is operatively connected to the spring retainer.

In still another embodiment of the second aspect of the present invention, the prong extension includes a prong latch having a first end and a second end such that the first end of the prong latch is attached to the second end of the prong extension, and a prong spring operatively connected to the prong latch.

In an even further embodiment of the second aspect of the present invention, the prong slot includes a plurality of holes located along a length of the prong slot, wherein the second end of the prong latch interacts with at least one of the plurality of holes in order to retain each of the two prongs in place.

In still another embodiment of the second aspect of the present invention, the non-slip jewelry holder includes at least one handle operatively attached to the first and second layers for carrying, displaying or holding up the non-slip jewelry holder.

A third aspect of the present invention is a method of using a non-slip container for storage, organizing, transporting, and displaying jewelry, including the steps of: employing a non-slip container having a first and second layer of a non-slip material located adjacent to each other, wherein the first layer includes a plurality of slits located along the first layer; at least one set of adjacent, adjustable prongs located between the first and second layers, wherein the set of adjacent, adjustable prongs includes two prongs located a distance from each other, wherein each of the two prongs include a prong retainer, a prong edge operatively connected to the prong retainer, a prong extension having a first end and a second end such that the first end of the prong extension is operatively connected to the prong edge and a prong slot such that the second end of the prong extension is operatively connected to the prong slot; and a jewelry holder fastener operatively connected to the first and second layers; determining, the size and number of pieces of jewelry to be located within the non-slip container; forming each of the pieces of jewelry into a separate loop having a loop diameter; adjusting a distance between the at least one set of adjacent, adjustable prongs so that the distance corresponds to the loop diameter; and placing the jewelry loop over each of the prong retainers such that the jewelry loop is located substantially under each of the prong retainers and the jewelry loop is located against each of the prong extensions.

In one embodiment of the third aspect of the present invention, the step of adjusting a distance between the least one set of adjacent, adjustable prongs includes the steps of: providing the prong slot with at least a spring having a first end and a second end and a spring retainer, wherein the second end of the prong extension is operatively connected to the first end of the spring and the second end of the spring is operatively connected to the spring retainer; and squeezing the at least one set of adjacent, adjustable prongs towards each other in order to adjust the distance between the least one set of adjacent adjustable prongs so that the distance corresponds to the loop diameter.

In a further embodiment of the third aspect of the present invention, the step of adjusting a distance between the least one set of adjacent, adjustable prongs includes the steps of: providing each of the adjustable prongs in the set of adjustable prongs with a prong latch having a first end and a second end such that the first end of the prong latch is attached to the second end of the prong extension; providing a prong spring operatively connected to the prong latch; providing a plurality of holes located along a length of the prong slot; locating at least one of the adjustable prongs of the set of adjustable prongs to a desired location along the prong slot; and attaching the second end of the prong latch to at least one of the plurality of holes, wherein the second end of the prong latch interacts with the at least one of the plurality of holes in order to retain each of the two prongs in place.

In another embodiment of the third aspect of the present invention, the method includes the step of: providing the non-slip container with at least one handle operatively attached to the first and second layers for carrying, displaying or holding up the non-slip container.

The preferred non-slip jewelry holder, according to various embodiments of the present invention, offers the following advantages: ease of use; lightness in weight; durability; excellent slip resistance characteristics; portability; excellent jewelry organization characteristics; ease of access to the jewelry; ability to hold a variety of sizes of jewelry; and the ability to connect a plurality of jewelry holders together. In fac in many of the preferred embodiments, these advantages are optimized to an extent that is considerably higher than heretofore achieved in prior, known jewelry holders.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF THE PREFERRED EMBODIMENTS OF THE INVENTION

In order to address the shortcomings of the prior, known jewelry holders, as discussed above, reference is made now to FIGS. 1 and 2, where there is illustrated non-slip jewelry holder 2. As will be explained hereinafter in greater detail, the non-slip jewelry holder 2 keeps each piece of jewelry taught to prevent from it from tangling with other pieces of jewelry or itself and employs a non-slip fabric such that the jewelry holder is easily portable and allows the jewelry to be organized and easy to access.

Figure 1:
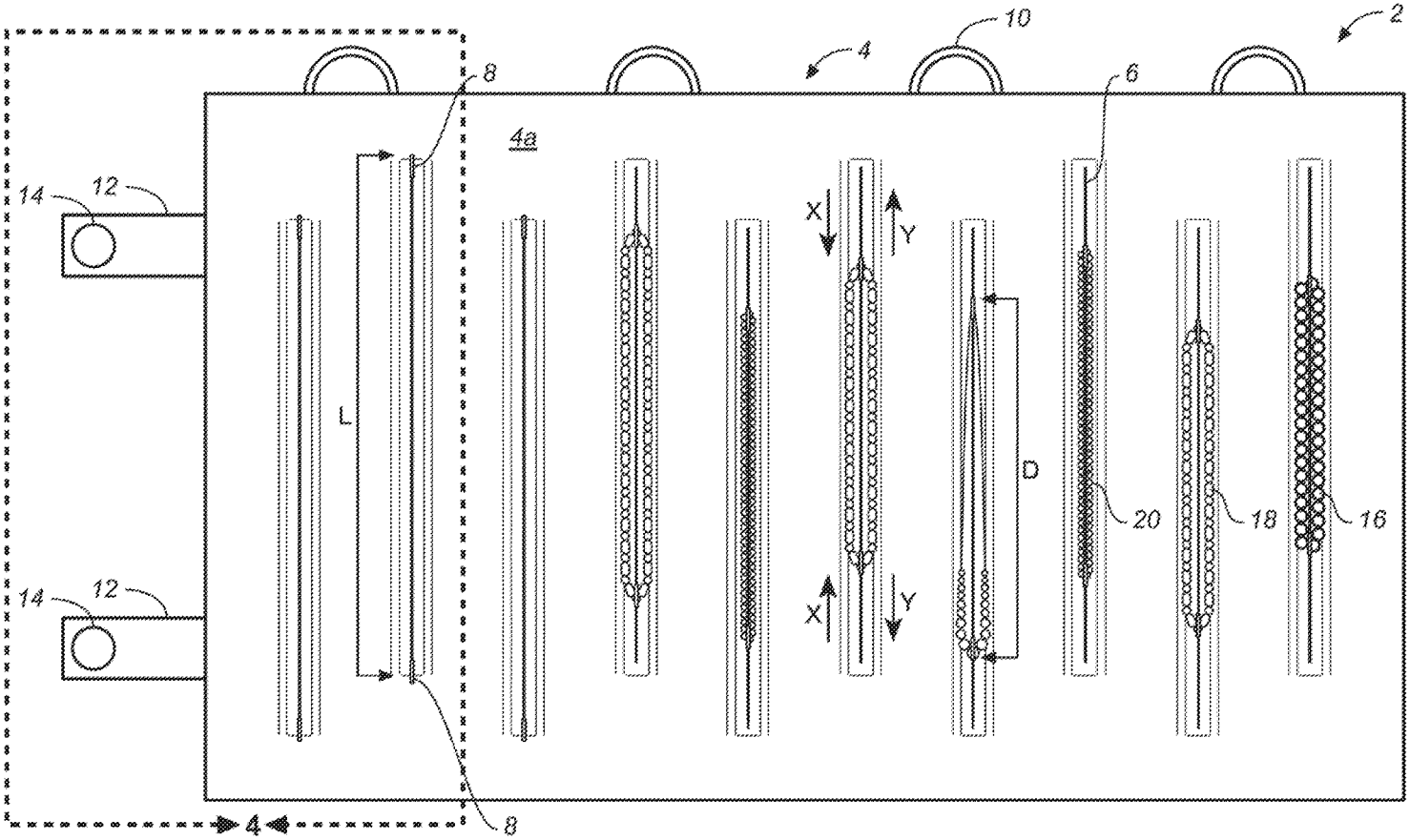
FIG. 1 is a front view of a non-slip jewelry holder, constructed according to the present invention.
Figure 2:
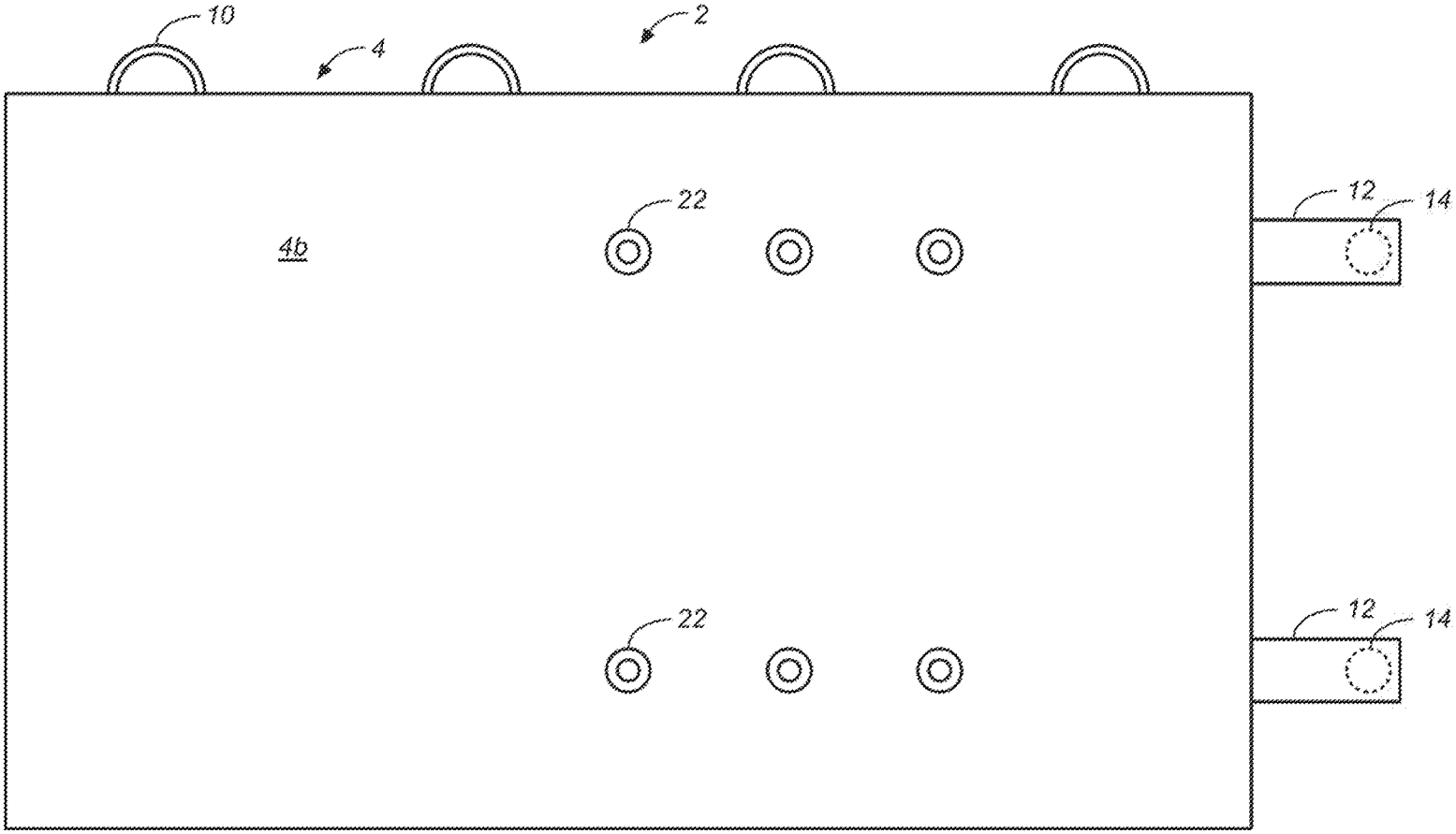
FIG. 2 is a back view of the non-slip jewelry holder, constructed according to the present invention.

As shown in FIGS. 1 and 2, there is illustrated non-slip jewelry holder 2 that is constructed according to the present invention. Non-slip jewelry holder 2 includes, in part, non-slip material layers 4, a plurality of slits 6 located on non-slip material layers 4, adjustable jewelry prongs 8, handles 10, jewelry holder connectors 12 fasteners 14, jewelry 16, 18, 20 and fasteners 22.

With respect to non-slip material layers 4, as will be described in greater detail later, non-slip material layers 4 include an upper layer 4*a* (FIG. 1) and a lower layer 4*b* (FIG. 2). Preferably, non-slip material layers 4 are constructed of any suitable non-slip material or fabric. An important feature of non-slip material layers 4 is that the jewelry 16, 18, and 20 should remain substantially in place on non-slip material layers 4 while the jewelry 16, 18 and 20 are being retained by adjustable prongs 8. Also, non-slip material layers 4 should be constructed so as to not adversely affect the jewelry 16, 18, 20 by scratching or otherwise damaging jewelry 16, 18, and 20.

Regarding slits 6, it is to be understood that slits 6 are conventionally formed in the top layer 4*a* (FIGS. 1 and 4) of non-slip material layers 4 by any suitable slit forming techniques. With respect to slits 6, a unique aspect of the present invention is that the plurality of slits 6, preferably, from 4 to 10 slits, can located on top layer 4*a*. The number of slits 6 can determine the number of pieces of jewelry that can be retained in non-slip jewelry holder 2. Also, another unique aspect of slits 6 is that the length (L) of the slits 6 can be adjusted to take into account the size (length) of the jewelry that is to be retained by a particular set of adjustable prongs 8. For example, a bracelet may only require a small distance (D) between a particular set of adjustable prongs 8 in order to properly retain the bracelet between the set of adjustable prongs 8. Conversely, a necklace will probably require a larger distance (D) between the set of adjustable prongs 8 in order to properly retain the necklace between the set of adjustable prongs 8. Therefore, the length (L) can be adjusted to account for the different distances (D) that each piece of jewelry requires. However, it is to be further understood that all of the slits 6 have been made with the same length (L).

With respect to adjustable prongs 8, preferably, prongs 8 are constructed of any suitable, durable material such metal or plastic. It is to be understood that the adjustable prongs 8 should be constructed of a size and shape so as to allow the jewelry to be easily and efficiently retained between each set of adjustable prongs 8 but also allow non-slip jewelry holder 2 to be easily rolled up and transported without adversely affecting the jewelry and/or the non-slip material 4. It is to be further understood that the location of the slits 6 and the adjustable prongs 8 can be staggered with respect to each other so that the adjustable prongs 8 will not be located on top of each other once the non-slip jewelry holder 2 is rolled up as shown in FIG. 1. Further specific details of the construction of adjustable prongs 8 will be described in greater detail later.

Regarding handles 10, handles 10, preferably, are conventionally attached to non-slip jewelry holder 2. Also, handles 10, preferably, are constructed of any suitable, durable material that can be readily attached to non-slip jewelry holder 2. A still further unique aspect of the present invention is that handles 10 can be used to carry, display or hold up non-slip jewelry holder 2. In this manner, the end user merely unrolls non-slip jewelry holder 2 and conventionally attaches handles 10 to any suitable fastener in order to display the jewelry retained within non-slip jewelry holder 2 or just to hold up non-slip jewelry holder 2 off of the ground or floor. It is to be understood that the number of handles 10 located on non-slip jewelry holder 2 can be varied depending upon the size of the non-slip jewelry holder 2 and/or the amount of jewelry to be retained within non-slip jewelry holder 2.

Figure 6:
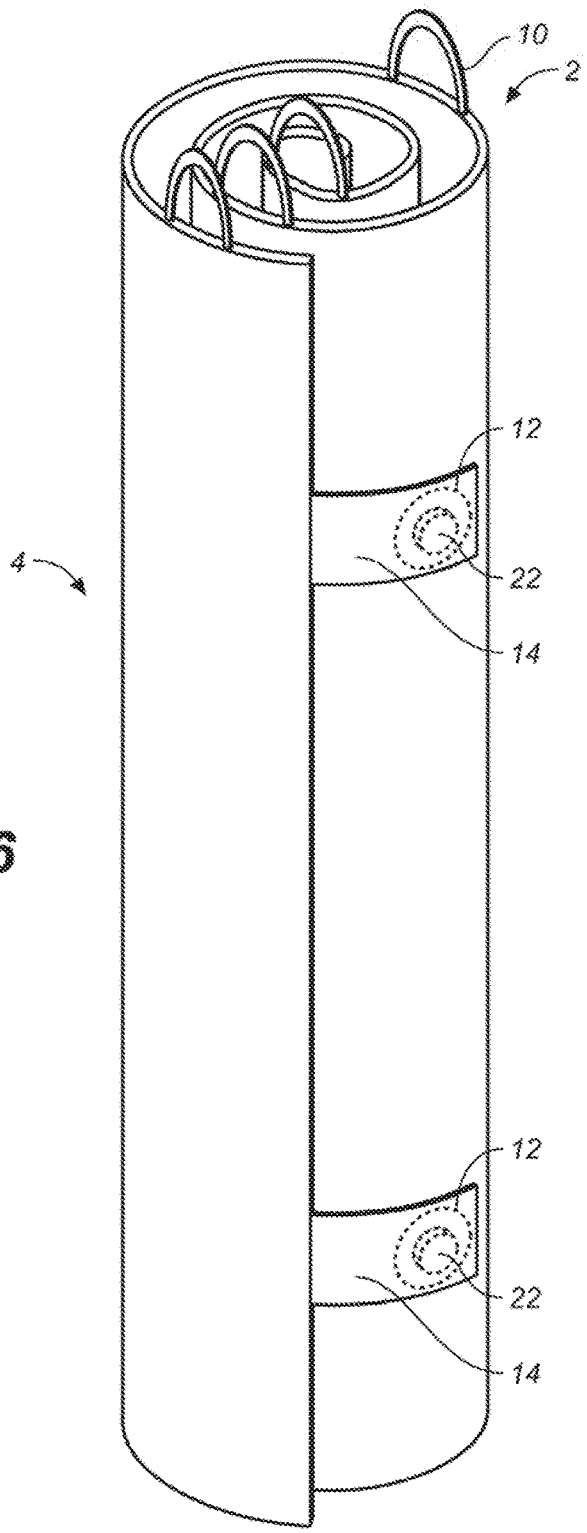
FIG. 6 is a schematic illustration of the jewelry holder being rolled up, according to the present invention.

With respect to jewelry holder connectors 12 and fasteners 14, preferably, jewelry holder connectors 12 are constructed of any suitable, durable material that can be readily attached to non-slip jewelry holder 2. Also, fasteners 14 and 22, preferably, are any suitable fastener, such as a snap fastener, that can be used in conjunction with each other in order to keep non-slip jewelry holder 2 in a rolled-up form, as shown in FIG. 6.

Another unique aspect of the present invention is that the use of jewelry holder connectors 12 and fasteners 14 and 22 allows the end user to attach a plurality of non-slip jewelry holders 2 together in order to form a larger non-slip jewelry holder 2. For example, the end user may want to retain metallic jewelry such as silver and gold jewelry in one non-slip jewelry holder 2 and retain diamond and other precious gem jewelry in another non-slip jewelry holder 2. In this case, the end user can store the metallic jewelry in one on-slip jewelry holder 2, store the precious gem jewelry in the other non-slip jewelry holder 2, connect the two non-slip jewelry holders 2 together by connecting the fasteners 14 of jewelry holder connectors 12 of the metallic jewelry non-slip jewelry holder 2 to the fasteners 22 of the precious gem non-slip jewelry holder 2. The end user can then simply roll up both of the non-slip jewelry holders 2 and fasten the rolled up non-slip jewelry holders 2, as discussed earlier. It is to be understood that the number of non-slip jewelry holders 2 that can be attached together is only limited by the size of the rolled-up collection of non-slip jewelry holders 2 that the end user desires to carry.

Regarding adjustable prongs 8, as shown in more detail in FIGS. 3A, 3B, 3C and 4, adjustable prongs 8 are part of adjustable prong system 50. As shown more clearly in FIG. 4, adjustable prong system 50 includes, in part, adjustable prongs 8, prong retainer 52, prong edge 54, prong extension 56, prong slot or rail 58, spring 60 and spring retainer 62. Another unique aspect of the present invention is that the end user simply pushes the set of adjustable prongs 8 together, along the direction of arrows X (FIGS. 3A and 36), loops or otherwise places the jewelry around the set of adjustable prongs 8 and the prongs 8 then move in the direction of arrows V (FIG. 3C) in order to properly retain the jewelry 16, 18, and 20 within the set of prong 8, a shown in FIG. 1.

With respect to prong retainer 52, prong retainer 52 is conventionally formed on prong 8 by conventional techniques. Another unique aspect of the present invention is that prong retainer 52 is used to keep the jewelry 16, 18, and 20 from sliding off of prong 8. In particular, when the jewelry is placed over a set of adjustable prongs, and around and under prong retainers 52 (FIG. 3B), once the adjustable prongs 8 extend back along the direction of arrows Y (FIG. 3C), the prong retainers 52 assist in helping to keep the jewelry from sliding around on non-slip jewelry holder 2 and assist in helping to keep the jewelry from sliding up and off of adjustable prongs 8.

Regarding prong edge 54, prong edge 54 is conventionally formed in adjustable prong 8 when prong retainer 52 is formed in adjustable prong 8. Prong extension 56 is attached to prong edge 54 and is used to interact with spring 60, as will be discussed in greater detail later. It is to be understood that prong retainer 52, prong edge 54 and prong extension 56 are constructed of any suitable, durable material such metal or plastic.

Figure 3A:
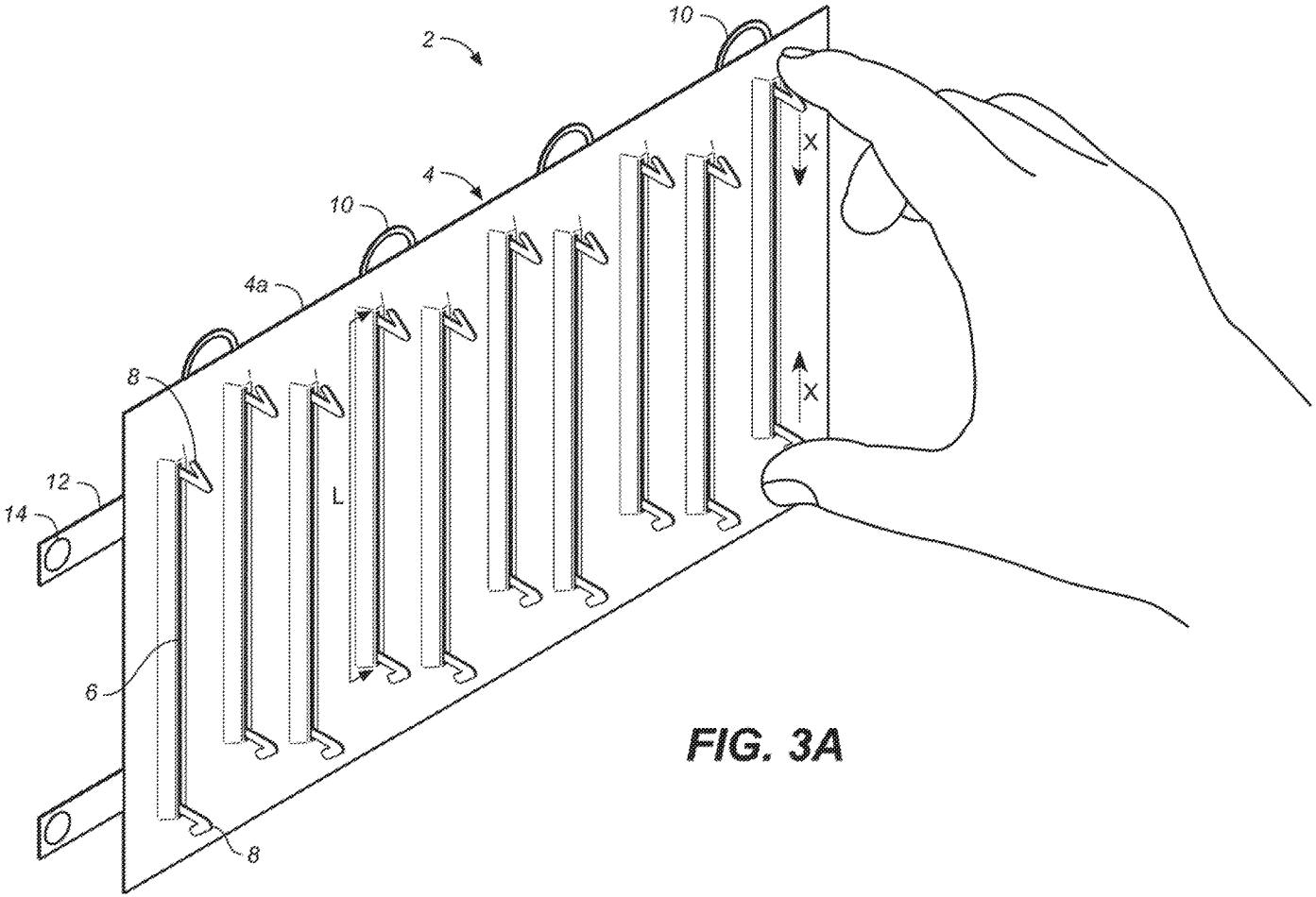
FIG. 3A-3C are detailed views of the movable prongs, constructed according to the present invention.
Figure 3B:
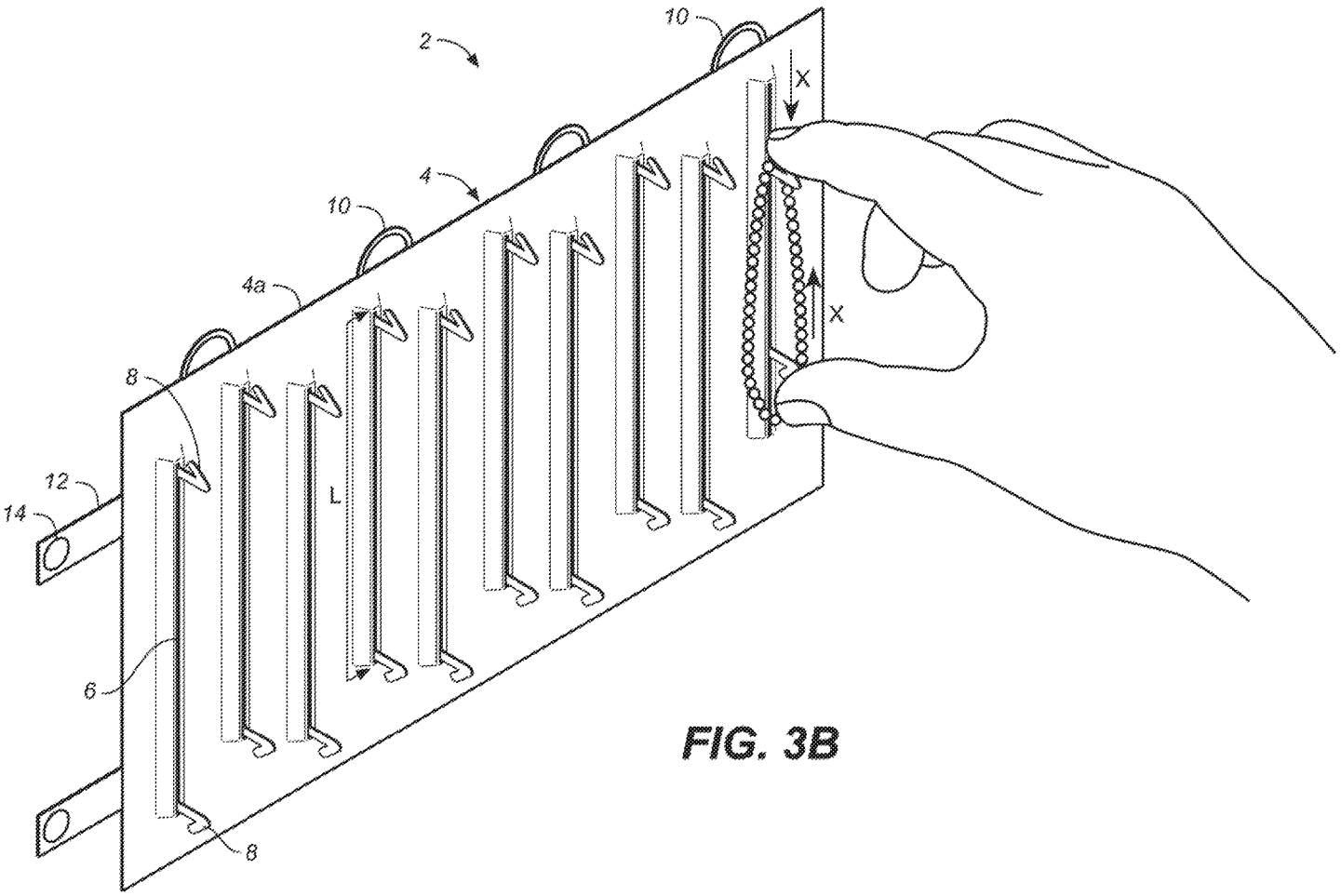

With respect to spring 60, preferably, spring 60 is constructed of any suitable, durable material such metal or plastic. An important feature of spring 60 is that spring 60 must be able to provide enough spring force so as to, cause a set of adjustable prongs 8 to move away from each other in the direction of arrows Y (FIG. 3C) and be able to properly retain the jewelry between a set of adjustable prongs 8 so that the jewelry does not dislodged from the set of adjustable prongs 8. However, the spring force of spring 60 must not be so great as to not allow an end user to be able to push or otherwise squeeze together adjustable prongs 8 in the directions of arrows X (FIGS. 3A and 3B).

Regarding prong slot or rail 58, prong slot or rail 58, preferably, is constructed of any suitable, durable material such metal or plastic. An important feature of prong slot or rail 58 is that prong slot or rail 58 must of a sufficient size and shape to be able to properly retain springs 60 and prong extension 56 so as to allow springs 60 to interact with prong extensions 56 in order to adjust the distance (D) between a set of adjacent prongs 8 (FIG. 1). Also, prong slot or rail 58 should also include spring retainer 62 which is used to abut or otherwise retain spring 60 within prong slot or rail 58. In this manner, spring retainer 62 is used to counteract the forces exerted by spring 60 on prong extension 56 as springs 60 push prong extensions 56 along the direction of arrows Y (FIGS. 3A and 3B).

It is to be further understood that prong slot or rail 58 can be equipped with only one spring 60. The other prong extension is conventionally attached to prong slot or rail 58. In this manner, the end user only has to move one adjustable prong 8 along the direction of arrow X especially if the end user has limited use in his/her hands.

Figure 4:
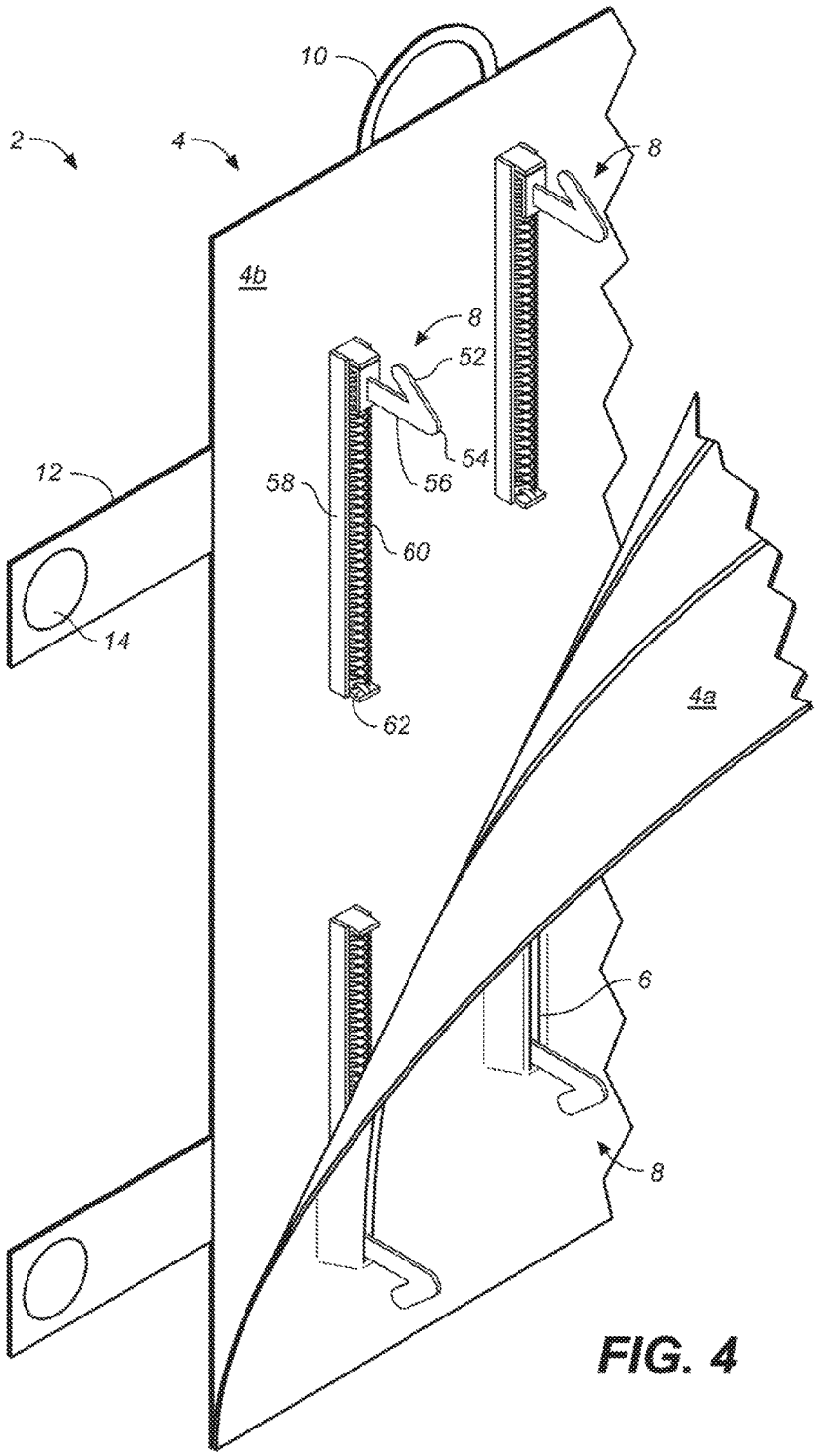
FIG. 4 is a more detailed view of the movable prongs with the upper layer of non-slip material exposed, taken from area 4 of FIG. 1, constructed according to the present invention.

With reference to FIG. 4, the location of adjustable prongs 8 with the two layers 4*a* and 4*b* of non-slip material 4 is illustrated. As shown in FIG. 4, located between the upper layer 4*a* of non-slip material 4 and the lower layer 4*b* of non-slip material 4 is adjustable prong system 50. However, it is to be understood that while adjustable prong system 50 is shown as being located between upper layer 4*a* of non-slip material 4 and the lower layer 4*b* of non-slip material 4, adjustable prong system 100 could also be located in a similar manner. As further shown in FIG. 4, prong extensions 56 are located in slit 6 of upper layer 4*a* and prong slot or rail 58 and springs 60 are located adjacent to lower layer 4*b*. In this manner, prong extensions 56 are able to slide or otherwise move along slit 6 and prong retainer 52 is located above upper layer 4*a* in order to be able to properly retain the jewelry within the set of adjustable prongs 8. Another unique aspect of the present invention is that slits 6 remain relatively closed except at the point where the adjustable prongs 8 are located along the slits 6. In this manner, any dirt, dust or other debris should be prevented from entering into prong, slot or rail 58 and/or springs 60. Also, the use of slits 6 prevents the jewelry from contacting or otherwise interacting with prong slot or rail 58 and/or springs 60 and possibly damaging or adversely affecting the jewelry.

Figure 5C:
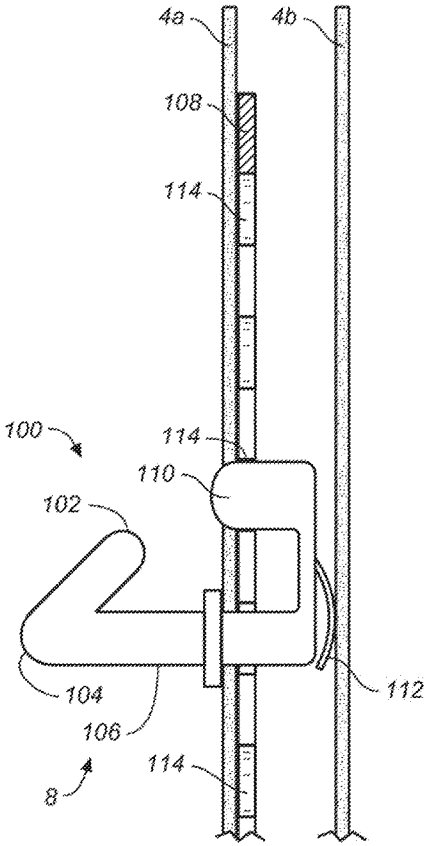
FIGS. 5A-5C are detailed views of another embodiment of the movable prongs, constructed according to the present invention.
Figure 5B:
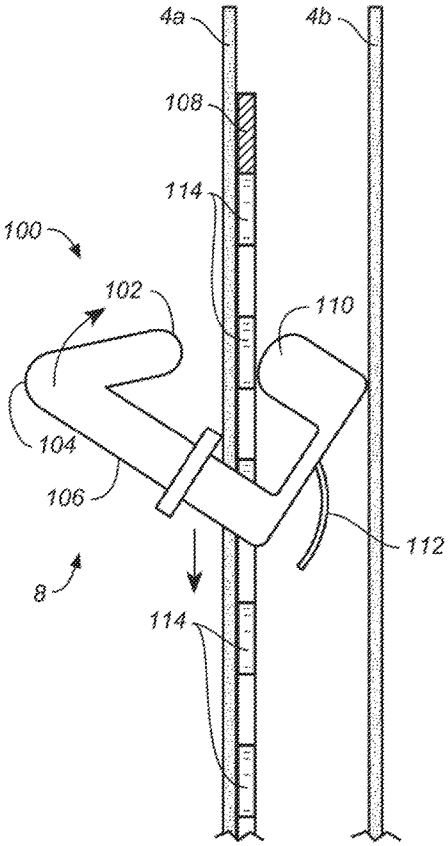
Figure 5A:
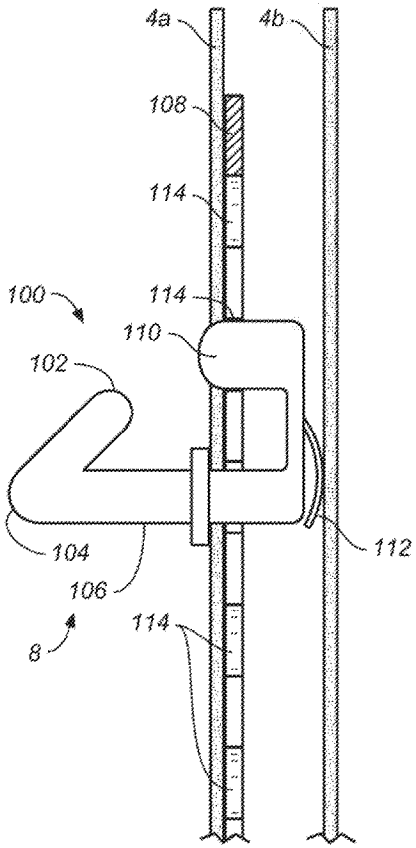

As shown in FIGS. 5A and 5B, there is illustrated another embodiment of adjustable prongs 8. In this embodiment, adjustable prongs 8 are part of adjustable prong system 100. Adjustable prong system 100 includes, in part, adjustable prongs 8, prong retainer 102, prong edge 104, prong extension 106, prong slot, or rail 108, prong latch 110, prong spring 112 and holes 114 in prong slot or rail 108. With respect to this embodiment, another unique aspect of the present invention is that the end user simply moves the set of adjustable prongs 8 together, along the direction of arrows X (FIGS. 3A and 3B), loops or otherwise places the jewelry around the set of adjustable prongs 8, and the prongs 8 are then moved (positioned) in the direction of arrows Y (FIG. 3G) until the jewelry is adequately retained within the set of adjustable prongs 8 in order to properly retain the jewelry within the set of prongs 8, as shown in FIG. 1.

With respect to prong retainer 102, prong retainer 102 is conventionally formed on prong 8 by conventional techniques. Another unique aspect of the present invention is that prong retainer 102 is used to keep the jewelry from sliding off of prong 8. In particular, when the jewelry is placed over a set of adjustable prongs 8 and around and under prong retainers 102, once the adjustable prongs 8 extend back along the direction of arrows Y (FIG. 3C), the prong retainers 102 assist in helping to keep the jewelry from sliding around on non-slip jewelry holder 2 and assist in helping to keep the jewelry from sliding up and off of adjustable prongs 8.

Regarding prong edge 104, prong edge 104 is conventionally formed in adjustable prong 8 when prong retainer 102 is formed in adjustable prong 8. Prong extension 106 is attached to prong edge 104 and is used to interact with prong latch 110, as will be discussed in greater detail later. It is to be understood that prong retainer 102, prong edge 104 and prong extension 106 are constructed of any suitable, durable material such metal or plastic.

With respect to prong latch 110, preferably, prong latch 110 is constructed of any suitable, durable material such metal or plastic. An important feature of prong latch 110 is that prong latch 110 must be able to properly interact with holes 114 in prong slot or rail 108 in order to properly secure prong 8 on prong slot or rail 108 and be able to properly retain the jewelry between a set of adjustable prongs 8 so that the jewelry does not dislodged from the set of adjustable prongs 8.

In order to properly retain adjustable prongs 8 within prong slot or rail 108, a leaf spring 112 is located below prong extension 106. In this manner, when the end user wants to change the distance (D) (FIG. 1) between a set of adjustable prongs 8, the end user simply pushes down on the prong edge 104 so that the prong latch 110 of adjustable prong 8 becomes dislodged from the hole 114. The end user then slides the set of adjustable prongs 8 to the desired holes so that the desired distance (D) (FIG. 1) is achieved. The end user then locates the prong latches 110 of each adjustable prong 8 in the new holes 114 and the springs 112 are used to retain the prong latches 110 within the location of the new hole or sets of holes, if both adjustable prongs 8 in a set of adjustable prongs 8 are being moved.

It is to be further understood that adjustable prong system 100 can be equipped with only one prong latch 110 and spring 112. The other prong extension 106 is attached to prong slot or rail 108. In this manner, the end user only has to move one adjustable prong 8 along the direction of arrow X (FIGS. 3A and 3B) especially if the end user has limited use in his/her hands.

Regarding prong slot or rail 108, prong slot or rail 108, preferably, is constructed of any suitable, durable material such metal or plastic. An important feature of prong slot or rail 108 is that prong slot or rail 108 must of a sufficient size and shape to be able to properly retain prong extension 106, prong latch 110 and springs 112 so as to allow springs 112 to interact with prong latch 110 in order to adjust the distance (D) between a set of adjacent prongs FIG. and still allow prong latch 110 to be properly retained within hole 114.

It is to be understood that while adjustable prong system 100 is shown to include, in part, adjustable prongs 8, prong retainer 102, prong edge 104, prong extension 108, prong latch 110, and prong spring 112 such that prong latch 110 interacts with holes 114 in rail 108, adjustable prong system 100 can instead be equipped with snaps or other similar fastening devices that allow adjustable prongs 8 to be readily attached and removed from rail 108 but still allow adjustable prongs 8 to be firmly retained in place in holes 114 of rail 108.

With reference now to FIG. 1-6, the operation and use of the non-slip jewelry holder 2 will now be discussed. As discussed earlier, the end user selects the piece of jewelry 16, 18, 20 to be retained within non-slip jewelry holder 2. Assume the pieces of jewelry are of different lengths. The end user then attaches the ends of the pieces of jewelry together to form loops of different sizes as shown by the different sizes of the loops of jewelry 16, 18 and 20 (FIG. 1).

After the jewelry has been formed into a loop having a particular loop diameter, the end user then squeezes or otherwise pushes together a set of adjacent, adjustable prongs 8 along the direction of arrows X (FIGS. 3A and 3B).

Figure 3C:
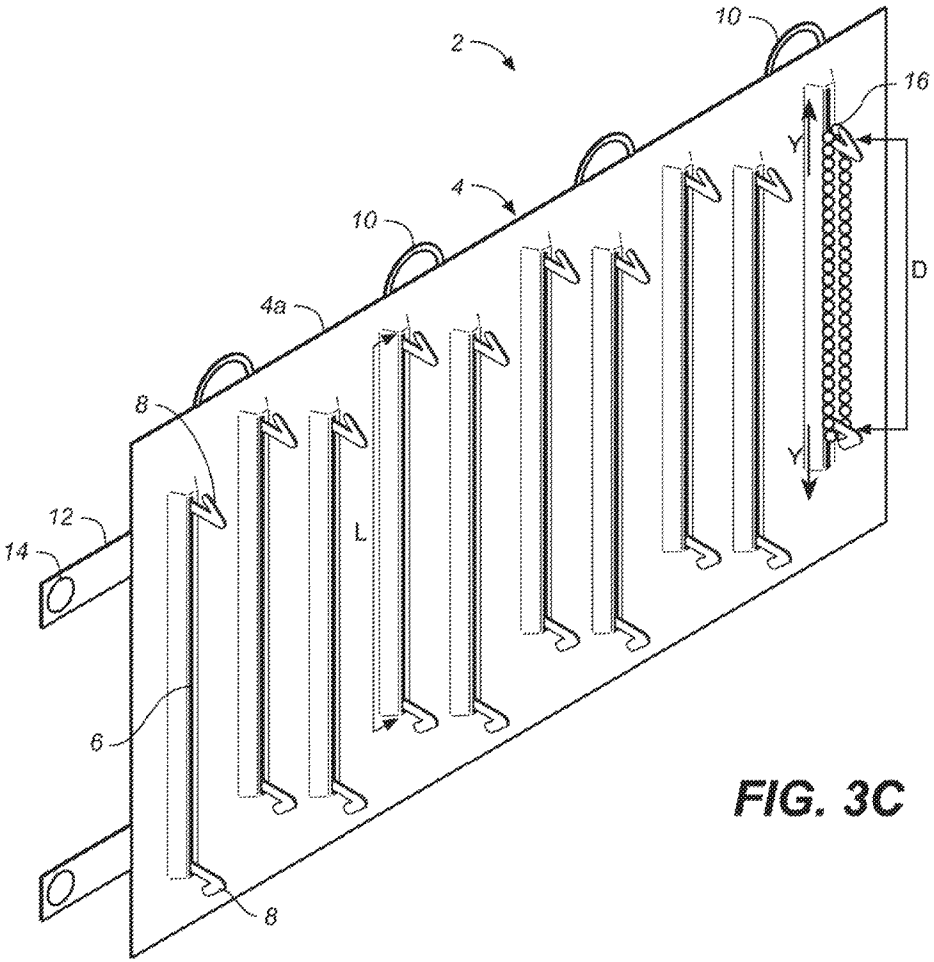

The end user then slides the loop of jewelry over each of the prong retainers 52 and releases the adjustable prongs 8 so that the adjustable prongs move in the direction of arrows Y (FIG. 3C). If the proper distance (D) (FIG. 1) between the set of adjustable prongs 8 has been selected by the end user, the prong extensions 56 will contact the loop of jewelry and extend out the loop of jewelry so as to properly retain the jewelry on the set of adjustable prongs 8. In this manner, there should be enough force being exerted by the springs 60 against the prong extensions 56 so as to slightly stretch out the loop of jewelry and keep the jewelry adequately retained within non-slip jewelry holder 2 but not enough spring force to break or otherwise damage the loop of jewelry. As discussed above, once the jewelry has been retained by springs 60 and prong extensions 56, prong retainers 52 will then be utilized to keep the jewelry from sliding off of adjustable prongs 8.

It is to be understood that if adjustable prong system 100 is used, the end user then moves the adjustable prongs 8 to the desired distance (D) (FIG. 1) so as to be able to adequately retain the jewelry in place. In this instance, the end user then attaches the prong latch 100 in the correct hole 114 so that spring 112 retains prong latch 110 in the proper hole 114. As discussed above, once the jewelry has been retained by prong latch 110, springs 112 and prong extensions 106, prong retainers 102 will then be utilized to keep the jewelry from sliding off of adjustable prongs 8.

As discussed above, if the end user needs to attach at least two (2) of the non-slip jewelry holders 2 together, the end user simply connects the two non-slip jewelry holders 2 together by connecting the fasteners 14 of the jewelry holder connectors 12 of the first jewelry non-slip jewelry holder 2 to the fasteners 22 of the second non-slip jewelry holder 2.

Once the end user has placed all of the desired jewelry in the non-slip jewelry holder 2, the end user can then simply roll up the non-slip jewelry holder; and; and fasten the rolled up non-slip jewelry holders 2 by conventionally connecting the fasteners 14 to the fasteners 22 (FIG. 6), as discussed earlier.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e. any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

Therefore, provided herein are a new and improved non-slip jewelry holder. The preferred non-slip jewelry holder, according to various embodiments of the present invention, offers the following advantages: ease of use; lightness in weight; durability; excellent slip resistance characteristics; portability; excellent jewelry organization characteristics; ease of access to the jewelry; ability to hold a variety of sizes of jewelry; and the ability to connect a plurality of jewelry holders together. In fact, in many of the preferred embodiments, these advantages of ease of use, lightness in weight, durability, excellent slip resistance characteristics, portability, excellent jewelry organization characteristics, ease of access to the jewelry, ability to hold a variety of sizes of jewelry, and the ability to connect a plurality of jewelry holders together are optimized to an extent that is considerably higher than heretofore achieved in prior, known jewelry holders.

I claim:

1. A non-slip jewelry holder which is capable of being rolled up, comprising:

a first and second layer of a non-slip material located adjacent to each other, wherein the first layer includes a plurality of slits located along the first layer;

at least one set of adjacent, adjustable prongs partially located between the first and second layers, wherein the at least one set of adjacent, adjustable prongs includes two prongs located a distance from each other, wherein each of the two prongs include:

a prong retainer;

a prong edge operatively connected to the prong retainer;

a prong extension having a first end and a second end such that the first end of the prong extension is operatively connected to the prong edge; and a prong slot such that the second end of the prong extension is located within one end of the prong slot, wherein the prong slot further includes:

a spring having a first end and a second end such that the spring is located within the prong slot; and a spring retainer located within the prong slot and located at another end of the prong slot, wherein the second end of the prong extension is operatively connected to the first end of the spring and the second end of the spring is operatively connected to the spring retainer;

wherein a portion of each prong extension extends a predetermined distance away from the first layer through a corresponding one of the plurality of slits such that a jewelry loop can be located under the prong retainer and a portion of the jewelry loop can be located against the prong extension in order to retain the jewelry loop on the prong; and a jewelry holder fastener operatively connected to the first and second layers in order to retain the non-slip jewelry holder in a rolled-up form holder, wherein the jewelry holder fastener allows an end user to attach a plurality of non-slip jewelry holders together in order to form a larger non-slip jewelry holder.

2. The non-slip jewelry holder, according to claim 1, wherein the non-slip material is further comprised of:

a non-slip fabric.

3. The non-slip jewelry holder, according to claim 1, wherein the prong retainer, the prong edge, and the prong extension are further comprised of:

metal or plastic.

4. The non-slip jewelry holder, according to claim 1, wherein the non-slip jewelry holder is further comprised of:

at least one handle operatively attached to the first and second layers for carrying, displaying or holding up the non-slip jewelry holder.

5. A non-slip container for storage, organizing, transporting, and displaying jewelry which is capable of being rolled up, comprising:

a first and second layer of a non-slip material located adjacent to each other, wherein the first layer includes a plurality of slits located along the first layer;

at least one set of adjacent, adjustable prongs partially located between the first and second layers, wherein the at least one set of adjacent, adjustable prongs includes two prongs located a distance from each other, wherein each of the two prongs include:

a prong retainer;

a prong edge operatively connected to the prong retainer;

a prong extension having a first end and a second end such that the first end of the prong extension is operatively connected to the prong edge; and a prong slot such that the second end of the prong extension is located within one end of the prong slot, wherein the prong slot further includes:

a spring having a first end and a second end such that the spring is located within the prong slot; and a spring retainer located within the prong slot and located at another end of the prong slot, wherein the second end of the prong extension is operatively connected to the first end of the spring and the second end of the spring is operatively connected to the spring retainer;

wherein a portion of each prong extension extends a predetermined distance away from the first layer through a corresponding one of the plurality of slits such that a jewelry loop can be located under the prong retainer and a portion of the jewelry loop can be located against the prong extension in order to retain the jewelry loop on the prong;

a jewelry holder fastener operatively connected to the first and second layers in order to retain the non-slip container in a rolled-up form, wherein the jewelry holder fastener allows an end user to attach a plurality of non-slip containers together in order to form a larger non-slip container; and a plurality of handles operatively attached to the first and second layers for carrying, displaying or holding up the non-slip container.

6. The non-slip container, according to claim 5, wherein the non-slip material is further comprised of:

a non-slip fabric.

7. The non-slip container, according to claim 5, wherein the prong retainer, the prong edge, and the prong extension are further comprised of:

metal or plastic.

* * * * *